US006000936A

United States Patent [19]

Taquet

[11] Patent Number: 6,000,936

[45] Date of Patent: Dec. 14, 1999

[54] ROTARY OVEN

[75] Inventor: Henri Jean-Pierre Joseph Taquet, Neupré , Belgium

[73] Assignee: Zinchem-Benelux, Machelen, Belgium

[21] Appl. No.: 09/043,352

[22] PCT Filed: Oct. 1, 1996

[86] PCT No.: PCT/BE96/00103

§ 371 Date: May 26, 1998

§ 102(e) Date: May 26, 1998

[87] PCT Pub. No.: WO97/14010

PCT Pub. Date: Apr. 17, 1997

[30] Foreign Application Priority Data

Oct. 6, 1995 [BE] Belgium ..... 9500829

[51] Int. Cl.[6] ..... F27B 7/00

[52] U.S. Cl. ..... 432/103; 432/104; 110/246

[58] Field of Search ..... 432/104, 103, 432/116, 118, 119; 110/246

[56] References Cited

FOREIGN PATENT DOCUMENTS 487190 6/1938 United Kingdom .
703035 1/1954 United Kingdom .

*Primary Examiner*—Philip H. Leung
*Assistant Examiner*—Jiping Lu
*Attorney, Agent, or Firm*—J. Warren Whitesel; Laff, Whitesel & Saret, Ltd.

[57] ABSTRACT

The invention relates to a rotating oven with a horizontal or inclined drum, of which at least the inner part is composed of a fireproof material and which is pivotably mounted around its longitudinal axis. The drum contains a tubular element (1) of a fireproof material which is composed of a succession of each other supporting co-axial rings (2), which element (1) is brought under an axial stress starting from its both extremities (6), in order to obtain a self supporting prestressed entity.

8 Claims, 3 Drawing Sheets

ROTARY OVEN

The present invention relates to a rotating oven with a horizontal or inclined drum, of which at least the internal side is composed of a fireproof material and which is pivotably mounted around its longitudinal axis.

It concerns here an oven which is suited for a direct type of heating, such as for example obtained when burning gasses are introduced in the drum, as well as for an indirect type of heating, i.e. when the heat supplience takes place via a heating room which surrounds the drum, or by electrical resistances or by hot gases which are produced in a combustion.

It concerns here more specifically an oven, which is preferably suited for chemical treatments that are performed in a continuous way, at a high temperature and under strictly controlled circumstances, for example a strongly reducing atmosphere.

In case of a direct heating, i.e. when it concerns ovens for which the for the process required calories are generated in situ or are delivered by hot gases circulating inside the drum, these are mostly formed by a drum which is manufactured according to the technique of the immuring of a metal ferrule.

It should however be remarked, that this direct heating is seldom adapted to a chemical process which should take place under strictly controlled circumstances and in particular strongly reducing circumstances, since the means which are applied for the delivering of the necessary calories in general interfere with the chemical reactions which take place therein.

For this type of chemical process, it is thus in most cases required that the calories are supplied by means which are outside these chemical reactions, which involves a heating oven of the indirect type. In general this can be obtained with an oven of which the drum is rotated within an electrical or a by means of combustion gases heated muffle.

Since the ceramic materials are in general bad heat conductors and show strongly differing expansions with respect to the metal ferrule, the immuring technique however involves some risks, because of the fact that the very high temperature to which the metal ferrule will be subjected, will cause a decrease or a loss of the sealing of the cementing work formed by the immuring technique, which will lead more or less rapid to a corrosion of the metal ferrule.

The present invention has the essential goal of remedying this important disadvantage by providing an original concept of a rotating oven with large dimensions, which is manufactured of a ceramic material, which allows a direct as well as an indirect heating at high temperature, with a very good efficiency, and which allows to avoid problems that could appear with respect to the sealing and the heat transfer throughout the wall of the drum of the oven.

To this end, said drum comprises a tubular element of a fireproof material, which is composed of a succession of each other supporting coaxial rings, which element is brought under an axial stress starting from its both extremities in such a way that a self supporting prestressed entity is obtained.

Preferably, said cilindrical element is stressed by means of pulling rods that are uniformly distributed over the cilindrical external side of this element.

According to a preferred embodiment of the invention, due to intervention of compressed springs, said pulling rods work axially to circular supporting means which are mounted on the external side of the tubular element, which means latch in longitudinal direction of the tubular element to the extrimities of the latter.

Other details and advantages of the invention will appear from the following description of a preferred embodiment of the invention, and this with reference to the enclosed drawings, which are given as a non-limitative example.

In the different figures, similar reference numbers refer to identical elements.

Figure 1:
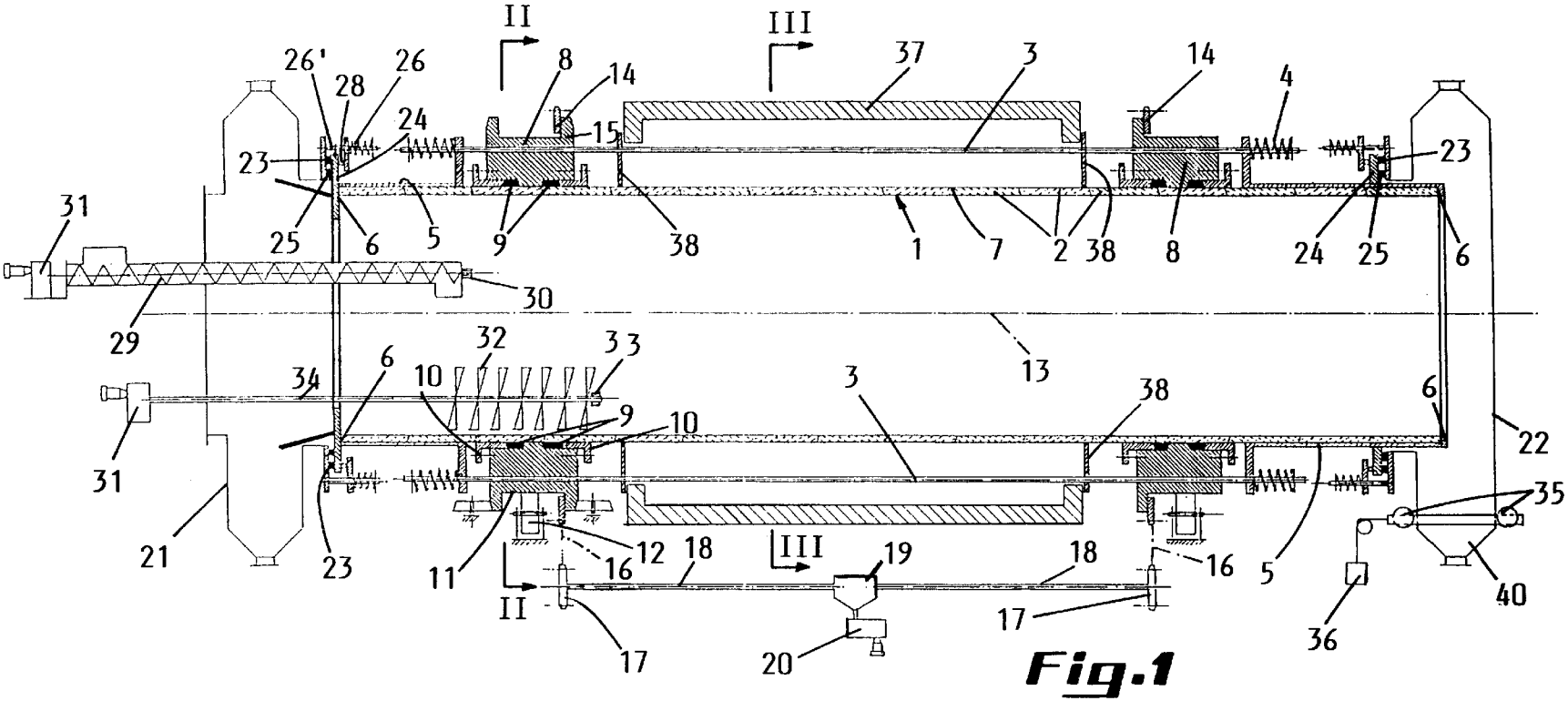
FIG. 1 is a schematical view of a longitudinal section through this embodiment of the rotating oven according to the invention.

The preferred embodiment of the oven according to the invention shown in the figures, comprises a rotating drum 1, which consists of a tubular element of fireproof material, formed by a succession of each other supporting co-axial rings 2. From its both extremities, this element is stressed axially by means of pulling rods 3 of a strong fireproof steel, which are uniformly distributed over its cilindrical external side.

By intervention of compressed coiled springs 4 the pulling rods 3 work axially to the circular supporting means 5, which are mounted on the external side of the tubular element 1.

These means 5 latch to the entire circumference of the terminal rims 6 of the element 1, and this along the longitudinal direction of the latter.

The pressure which is exerted to these rims 6, is such that the tubular element 1, which is formed by the separate rings 2, becomes self supporting, whereby the occurence of pulling forces between the rings, as a consequence of their own weight and the weight of the material that is continuously to be treated in the oven, is avoided.

Because of this, the sealing of the joints between the rings is guaranteed and the use of fireproof materials, which may only be subjected to very small pulling forces, becomes possible.

In this embodiment, these rings are preferably composed of a siliciumcarbide which shows a good heat conduction and a good behaviour at high temperatures.

In the embodiment shown in the figures, the support planes 7 of the rings 2 are beveled slightly, in order to centre the latter during the assemblence of the tubular element 1.

To guarantee the sealing between two successive rings, the latter are further mutually connected to each other by intervention of a film which is formed of a siliciumcarbide mortar.

The said pulling rods 3 extend through supporting crowns 8, which are speared to the external side of the tubular element 1, and this by intervention of gaskets 9 of ceramic fibers which are pressed together by pressure gaskets 10.

The crowns show a running strip 11, rest on free rotating rolls 12 and cooperate with a driving mechanism, which allows the rotation of the tubular element 1 around its axis 13.

In the embodiment shown in the figures, this driving mechanism comprises on each crown 8 a co-axial, toothed ring 14, which is attached to an upright rim 15 of these crowns 8 and which extends entirely around the tubular element 1. The two rings 14 are driven by means of two endless chains 16, which move around the latter and around two gear wheels 17 which are fixed to the extremities of two driving axles 18, which driving axles 18 come together in a differential conical gear wheel transmission 19 (which guarantees an identical strain to the two chains). The rotational energy for these driving axles 18 is supplied by a classical driving device 20, which is formed by means of an electric motor with a hydraulic coupling or by means of a hydraulic or pneumatic motor which cooperates with the conical gear wheel transmission 19.

The free extremities of the tubular element 1 are connected to caissons 21 and 22, this by intervention of a rotating sealing system which is provided between two fixed flanges 23 and 24, which are respectively fixed to the caissons 21 and 22 and to the supporting means 5.

This sealing system comprises circular sealants 25, which are compressed between the flanges 23 and 24 by means of reactive springs 26, which springs are drawn over sticks 26', which are fixed to the flanges 23 in such a way that they stick out beyond the flanges 24. These springs 26 push against a ring 27, which also pushes against the flanges 24 by intervention of bullets 28.

Throughout the frontal caisson 21, which is fixed, a supply screw 29 extends, which is mounted on a bearing of ceramic material within the tubular element 1 and on an external ball-bearing 31. As is shown in FIG. 1, this screw 29 extends over a certain distance within the tubular element 1.

A scraper 32 of ceramic material or fireproof steel, which also rests upon a bearing 33, within the tubular element 1, provides the cleaning of the internal wall of this element. This scraper 32 is mounted on a driving axle 34, which is parallel to the wall of the element 1, and which extends throughout the lower part of the caisson 21.

The rear caisson 22 is axially movable and is mounted on rolls 35 to allow in that way a compensation of the longitudinal expansion of the tubular element 1, during the heating thereof. A counter weight 36 allows that the caisson 22, during the cooling of the oven, returns to its initial position, whereby care should be taken for the sealing to be maintained at the position of the sealant 25.

Figure 2:
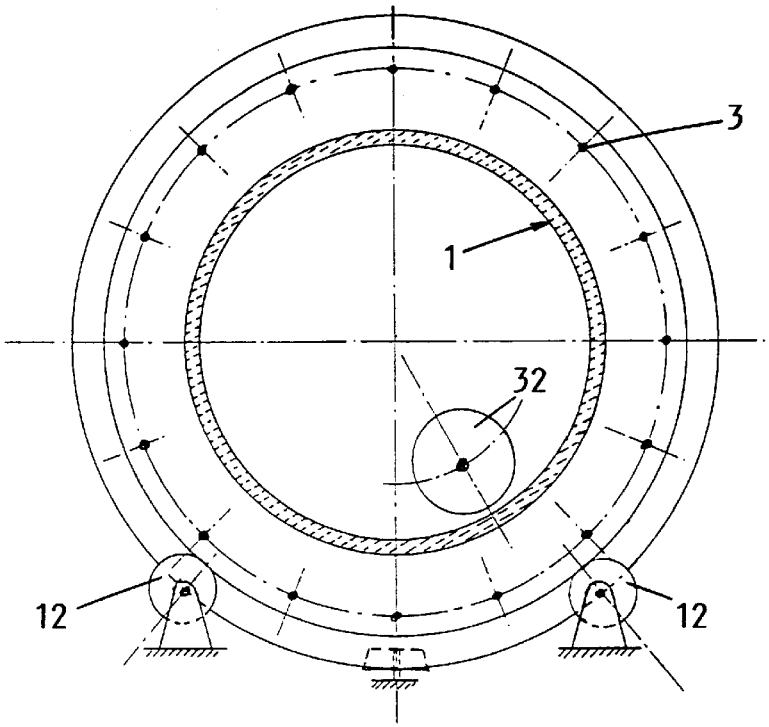
FIG. 2 is a section along line II—II of FIG. 1 wherein some parts have been omitted for the sake of clarity.
Figure 3:
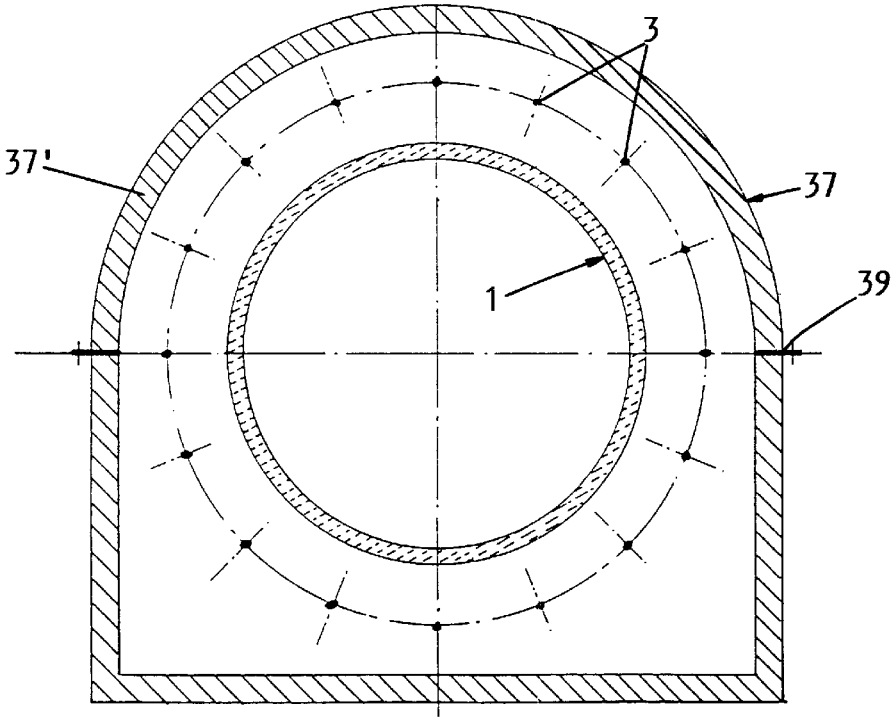
FIG. 3 is a section along line III—III of FIG. 1.
Figure 4:
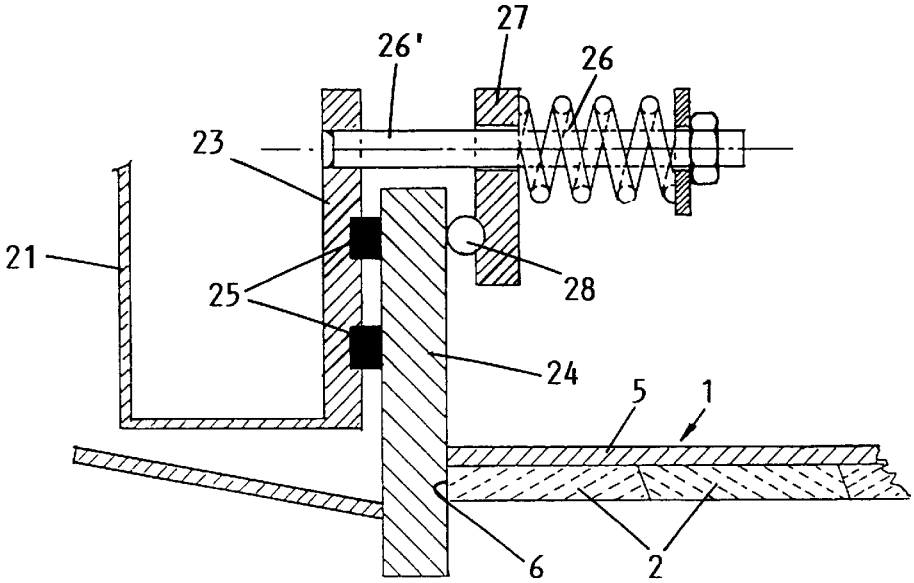
FIG. 4 is also a section, but on an enlarged scale, partly showing a detail of FIG. 1.
Figure 5:
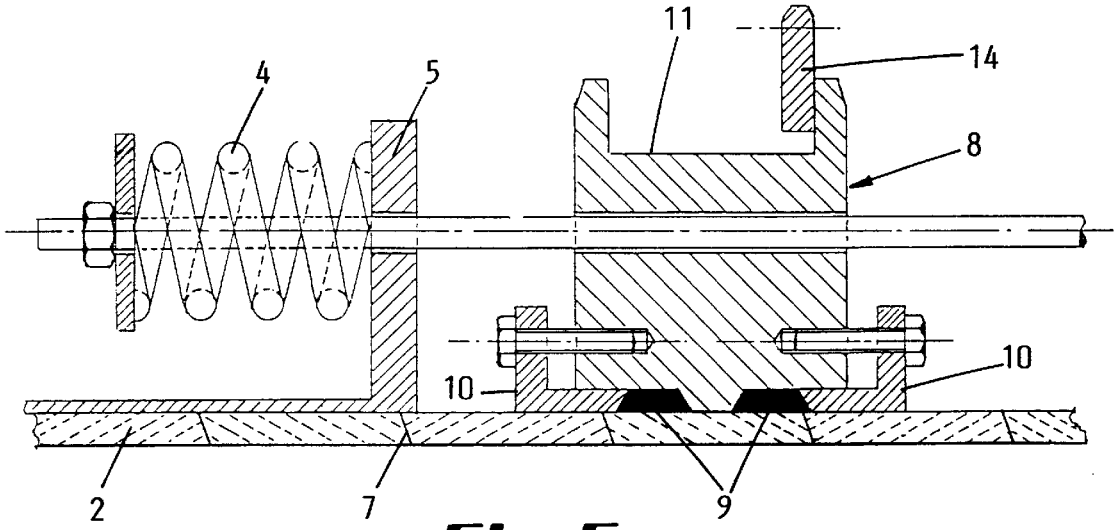
FIG. 5 shows, on an enlarged scale, another detail of FIG. 1.

In the embodiment of the oven shown in FIGS. 1 to 3, the heating occurs by intervention of a muffle or of a compartment 37, which surrounds the tubular element 1 between the supporting crowns 8. This compartment 37 can be heated electrically or by intervention of gas or fuel burners. Such a heating is however not shown in the attached figures.

The sealing of this compartment 37 is guaranteed by crowns 38 of fireproof material, which are drawn over the pulling rods 3 and which are fixed to the external side of the tubular element 1.

As is shown in FIG. 3, this heating compartment 37 is provided with a sealing 39 at the position of the axle 13 of the tubular element 1, in order to give access to the latter by lifting the upper part 37' of compartment 37.

In order to allow a continuous operation of the oven, the oven is inclined slightly to the rear caisson 22. The material to be treated in the oven can thus be supplied by means of the screw 29 at the entrance of the tubular element 1, and can gradually move to the caisson 22, due to said inclination of the axle 13, during rotation of the element 1 around its axle 13, the bottom of which caisson shows a discharge funnel 40.

In order to allow a direct heating, in an embodiment of the oven according to the invention, the heating compartment 37 can be omitted and be replaced by one or more, for example burners that are mounted in the caisson 22.

Hereafter, two actual embodiments of the oven according to the invention, as shown in the figures, are given.

EXAMPLE 1

Pilot oven composed of 7 SiC rings, each having an external diameter of 390 mm, a length of 870 mm and a thickness of 20 mm.

The thus formed tube is held together by means of 12 fireproof pulling rods in steel ($\sigma_E$: 185 MPa at 870° C.) with a diameter of 24 mm and a length of 5,630 m.

Due to the intervention of springs 24 with a mean diameter of 61 mm and a thread diameter of 12 mm, a prestress is obtained.

To each extremity, the tube is provided with a fixed caisson which guarantees the sealing. The supply is realised by means of an Archimedes screw, while the equipment can be completed with a ceramic scraper.

The heating is realised in an indirect way by means of an external muffle which is provided with electrical resistors, divided over the entire length of the muffle.

The oven is driven via chain crowns by an electrical motor.

EXAMPLE 2

Production oven composed of 47 SiC rings, each with an external diameter of 1200 mm, a length of 250 mm and a thickness of 30 mm.

These 47 rings are held together by means of 16 fireproof pulling rods in steel ($\sigma_E$: 185 MPa at 870° C.) with a diameter of 38 mm and a length of 11 m. Due to the intervention of 32 springs with a mean diameter of 73 mm and a thread diameter of 12 mm, a prestress is obtained.

The heating is realised in an indirect way by means of an external muffle which is provided with electric resistors over a length of 8 m.

The rotation of the oven is obtained by means of an electric motor.

This oven is feeded by an Archimedes screw and can be equipped with a ceramic scraper.

The concept of the tubular element 1, composed of a succession of relatively small rings of a ceramic material without a metal frame, is especially of interest for the construction of ovens on an industrial scale, destinated for the treatment of material under controlled circumstances and/or under an atmosphere which can release corrosive gases. It concerns thus sealed ovens, which can preferably work with an indirect heating.

It should be clear that the invention is not limited to the preferred embodiment as shown in the figures, but that different variants could be taken into consideration without extending beyond the scope of the present invention.

I claim:

1. A rotating oven comprising:

a drum mounted in a generally horizontal or inclined position, said drum having a longitudinal axis and at least an internal side composed of a fireproof material, and means for pivotally mounting said drum around said longitudinal axis, said drum further comprising a cylindrical tubular element made of a fireproof material composed of a succession of coaxial rings supporting each other, and a plurality of pulling rods which are uniformly distributed around a cylindrical external surface of said tubular element, said pulling rods axially stress the tubular element between its opposite extremities, said axial stress acting in a manner such that the coaxial rings form a self supporting prestressed entity tubular element of fireproof material; and supporting means mounted on the external surface of the tubular element near said opposite extremities, said pulling rods being fastened to said supporting means in order to axially apply said stress thereon, and said supporting means being latched in the direction of the longitudinal axis of the tubular element.

2. The oven according to claim 1, wherein a plurality of supporting crowns are on the external surface of the tubular element, and said pulling rods extend through said supporting crowns.

3. The oven according to claim 2, wherein the supporting crowns rest on the free rotating rollers; and means cooperating with said rollers for enabling a rotation of the tubular element around its axis.

4. The oven according to claim 1, wherein said tubular element has free extremities connected to caissons by means of a rotating sealing system.

5. The oven according to claim 1, wherein said rings are provided with beveled support planes in order to center the coaxial rings.

6. The oven according to claim 1, wherein the rings are composed of siliciumcarbide.

7. The oven according to claim 1, wherein a sealing film of a siliciumcarbide mortar is provided between the edges of successive rings.

8. The oven according to claim 1, wherein said tubular element has two extremities, further comprising an entrance at a first of said extremities for continuously supplying a material to be treated, and a discharge at a second of said extremities for continuously discharges a treated material, whereby a continuous processing may be carried out.

* * * * *